US006208830B1

(12) United States Patent
Takeda

(10) Patent No.: US 6,208,830 B1
(45) Date of Patent: Mar. 27, 2001

(54) PRINTING APPARATUS HAVING IMPROVED PAPER CUTTING FUNCTION

(75) Inventor: Ikuo Takeda, Hyogo (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/428,538

(22) Filed: Oct. 28, 1999

(30) Foreign Application Priority Data

Mar. 23, 1999 (JP) ..... 11-077909

(51) Int. Cl.[7] ..... G03G 15/00; B41J 11/66
(52) U.S. Cl. ..... 399/385
(58) Field of Search ..... 399/385, 387, 399/384; 226/101

(56) References Cited

U.S. PATENT DOCUMENTS 4,248,523 * 2/1981 Doi et al. ..... 399/387
5,121,867 * 6/1992 Aoyama et al. ..... 226/101

FOREIGN PATENT DOCUMENTS 57-167281 10/1982 (JP) .
61-229770 10/1986 (JP) .
3-87274 * 4/1991 (JP) .
7-304220 11/1995 (JP) .

* cited by examiner

*Primary Examiner*—Quana M. Grainger
(74) *Attorney, Agent, or Firm*—Armstrong, Westerman, Hattori, McLeland & Naughton

(57) ABSTRACT

A printer is provided which includes an image forming section for forming an toner image on a surface of a photosensitive drum, a paper feeding unit for feeding continuous paper along a feeding path to the surface of the photosensitive drum, and a cutting unit for cutting the continuous paper to provide cut sheets. The cutting unit is arranged to cut the continuous paper after the leading portion of the continuous paper reaches the surface of the photosensitive drum.

17 Claims, 7 Drawing Sheets

PRINTING APPARATUS HAVING IMPROVED PAPER CUTTING FUNCTION

BACKGROUND OF THE INVENTION

1. Field of the Invention

The present invention relates to a printing apparatus for printing images using, a photosensitive unit such as a photosensitive drum. In particular, the present invention relates to a printer incorporating a paper-cutting mechanism to cut continuous recording paper into separate cut sheets for printing desired images on these cut sheets.

2. Description of the Related Art

A conventional printer of the above type is disclosed in JP-A-7(1995)-304220 for example. As shown in FIG. 7 of the accompanying drawings of the present application, the conventional printer has an image forming section provided with a photosensitive belt 90, a transfer unit 91 and a fixation unit 92. The printer also includes a paper holder 93 for accommodating a paper roll R. Continuous recording paper 94 is paid out from the paper roll R to be brought into contact with the photosensitive belt 90 by a plurality of feed rollers 95.

In the conventional printer, use is made of a sensor 96 and a cutter 97, each of which is arranged at a suitable location along the feeding path of the continuous paper 94. The sensor 96 is provided for detecting the passage of the continuous paper 94, while the cutter 97 is provided for cutting the continuous paper 94. More specifically, the sensor 96 is arranged to detect the passage of the leading portion of the continuous paper 94. Upon such detection, the continuous paper 94 is advanced a predetermined distance toward the photosensitive belt 90. Then, after the continuous paper 94 has been thus moved, the cutter 97 is operated to cut the continuous paper 94 to provide a cut sheet of a predetermined size.

The advantages of the conventional printer are as follows. Firstly, the recording paper 94 is a single elongated sheet when it is drawn out from the paper holder 93. Thus, the recording paper 94 will not suffer the problem of "double feed" which is liable to occur when initially separate cut sheets are used in place of the continuous paper 94.

Secondly, the continuous paper 94 is not allowed to maintain its continuous form but is cut into separate sheets by the cutter 97 arranged upstream from the photosensitive belt 90. With such an arrangement, the mechanisms of components arranged behind (i.e., downstream from) the photosensitive belt 90 are advantageously simplified, as in a specialized printer which is designed to deal with cut sheets only. This advantage can be better understood by considering the following case.

If the continuous paper 94 is not to be cut into separate cut sheets at all, additional devices, which would otherwise be unnecessary, may be required. The additional devices may include devices to detach the photosensitive belt 90 and the fixation unit 92 from the continuous paper 94 when the printing operation should be halted temporarily. Such detachment is needed for protecting the belt 90 from possible mechanical damage inflicted by the continuous paper 94, and for protecting the paper 94 from possible thermal damage inflicted by the fixation unit 92. The additional devices may also include a folding device for the continuous paper 94. The folding device may be disposed at the end of the feeding path for alternately folding the continuous paper 94, so that the discharged paper 94 is neatly accommodated in a stacker.

Though the conventional printer possesses the above advantages, it has been found disadvantageous in the following points.

In the conventional printer, the continuous paper 94 is cut into a separate sheet before the leading portion of the continuous paper 94 comes into contact with the photosensitive belt 90. Thus, the cut sheet separated from the continuous paper 94 needs to be transferred a certain distance until it comes into contact with the photosensitive belt 90. In this manner, the cut sheet tends to be improperly oriented (skewed for example) during the transfer to the photosensitive belt 90. When such improper transfer occurs, the cut sheet may fail to come into square contact with the photosensitive belt 90. Consequently, the printing operation may be started at an unintended portion of the cut sheet, and the resulting image printed on the cut sheet may unfavorably be slanted.

SUMMARY OF THE INVENTION

The present invention has been proposed under the above circumstances, and its objective is to eliminate, or at least reduce, the problems described above.

For attaining the above objective, the present invention takes the following technical measures.

According to the present invention, there is provided a printer with a photosensitive member comprising:

- an image forming section for forming an toner image on a surface of the photosensitive member;
- continuous paper to which the toner image is transferred from the photosensitive member;
- a paper feeding unit for feeding the continuous paper along a feeding path to the surface of the photosensitive member; and
- a cutting unit for cutting the continuous paper to provide a cut sheet, the cutting unit being arranged upstream from the photosensitive member;
- wherein the cutting unit is arranged to cut the continuous paper after a leading portion of the continuous paper reaches the surface of the photosensitive member.

With such an arrangement, when the continuous paper is cut by the cutting unit, the leading portion of the continuous paper has already arrived at the surface of the photosensitive member. Thus, as opposed to the conventional printer, the cut sheet separated from the continuous paper does not need to be transferred to the photosensitive member. In this manner, the positioning of the cut sheet relative to the photosensitive member can be accurately performed. As a result, it is possible to reduce, or even eliminate, the positional deviation of the image to be printed on the cut sheet.

According to a preferred embodiment, the printer may further comprise a detector for detecting the leading portion of the continuous paper, wherein the detector is arranged upstream from the photosensitive member.

With such a printer provided, the paper feeding unit may be arranged to advance the continuous paper by a predetermined amount after the leading portion of the continuous paper is detected by the detector.

Further, the cutting unit may be arranged to cut the continuous paper after the continuous paper is advanced by said predetermined amount.

Preferably, the paper feeding unit of the printer may comprise at least one tractor including a rotating member provided with a plurality of protrusions which are inserted into feed holes formed in the continuous paper.

With such an arrangement, the problem of possible slip or positional deviation of the continuous paper with respect to the paper feeding unit can be overcome.

Preferably, the feed holes may be disposed along a longitudinal edge of the continuous paper at regular intervals.

Preferably, the rotating member may be an endless belt or a roller.

Preferably, the continuous paper may be provided with cut lines arranged at regular intervals longitudinally of the continuous paper, and each of the cut lines may include at least one cut.

The cutting unit may be arranged to cut the continuous paper at the cut lines.

Preferably, the cutting unit may be movable along the feeding path of the continuous paper. With such an arrangement, by adjusting the fixing position of the cutting unit along the feeding path, the length of the cut sheet separated from the continuous paper can be varied.

Advantageously, the paper feeding unit may include an additional tractor arranged downstream from the above-mentioned one tractor.

Further, the above-mentioned one tractor may preferably be arranged to exert a resisting force on the continuous paper advancing along the feeding path, so that the continuous paper is cut at a cut line.

With such an arrangement, the paper feeding unit can achieve two functions, that is, the paper feeding function and the paper cutting function. In this situation, there is no need to render the printer to incorporate a specialized cutting means for cutting the continuous paper, whereby the construction of the printer can be simplified.

When the paper feeding unit is to be used for cutting the continuous paper, the additional tractor may be driven at a higher rate than the above-mentioned one tractor is. In this manner, a suitable tension is generated in a portion of the continuous paper between the two tractors, the continuous paper will be cut at the cut line.

Preferably, the cut of the cut line may be arranged to avoid a portion of a longitudinal edge of the continuous paper. With such an arrangement, the pulling force from the paper feeding unit is properly transferred to the continuous paper.

Preferably, each of the cut lines may include a relatively long cut and a relatively short cut which are arranged to avoid a portion of a longitudinal edge of the continuous paper.

Other objects, features and advantages of the present invention will become clearer from the following detailed description given with reference to the accompanying drawings.

DETAILED DESCRIPTION OF THE PREFERRED EMBODIMENTS

The preferred embodiments of the present invention will be described below with reference to the accompanying drawings.

Figure 1:
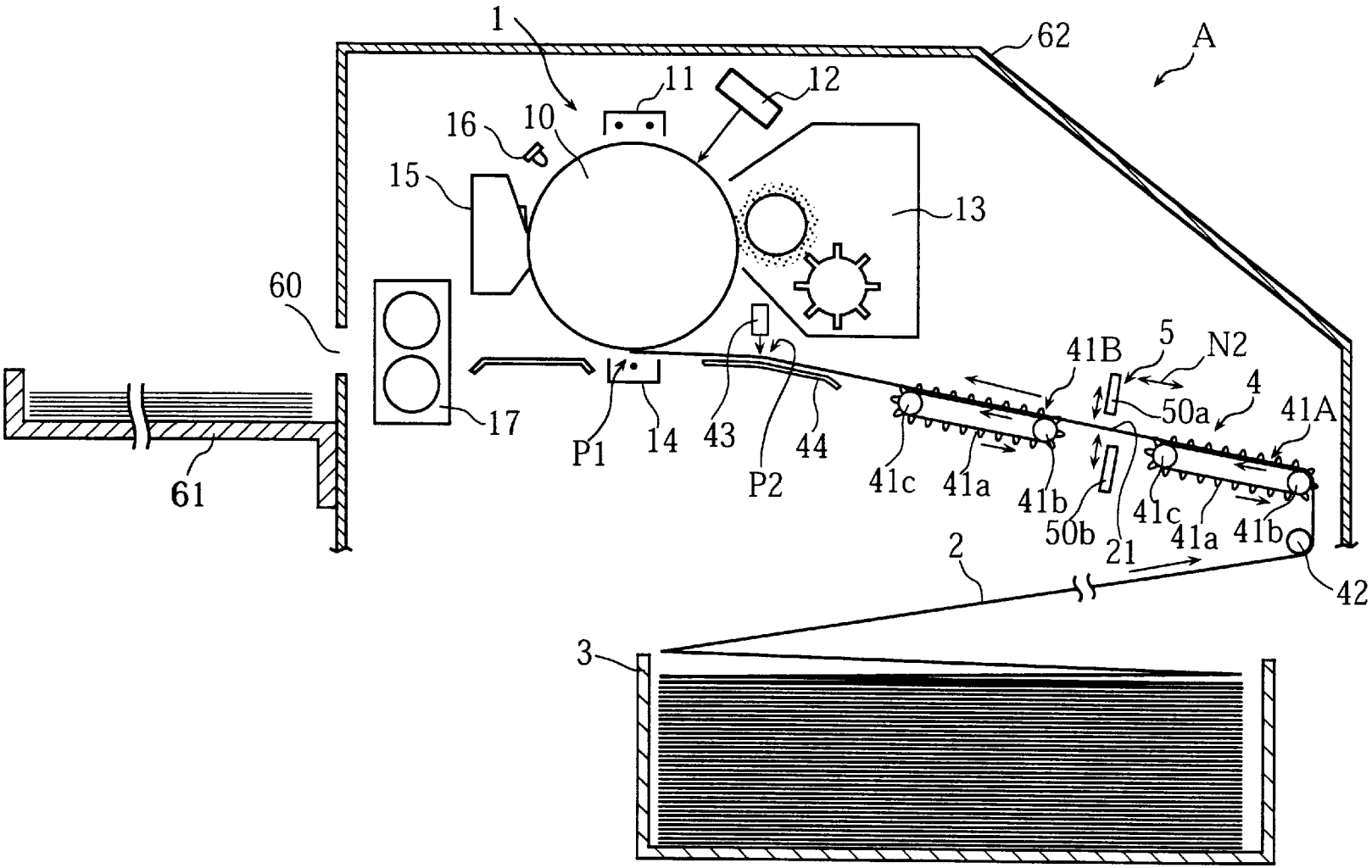
FIG. 1 is a schematic view showing an example of printer according to the present invention.
Figure 2:
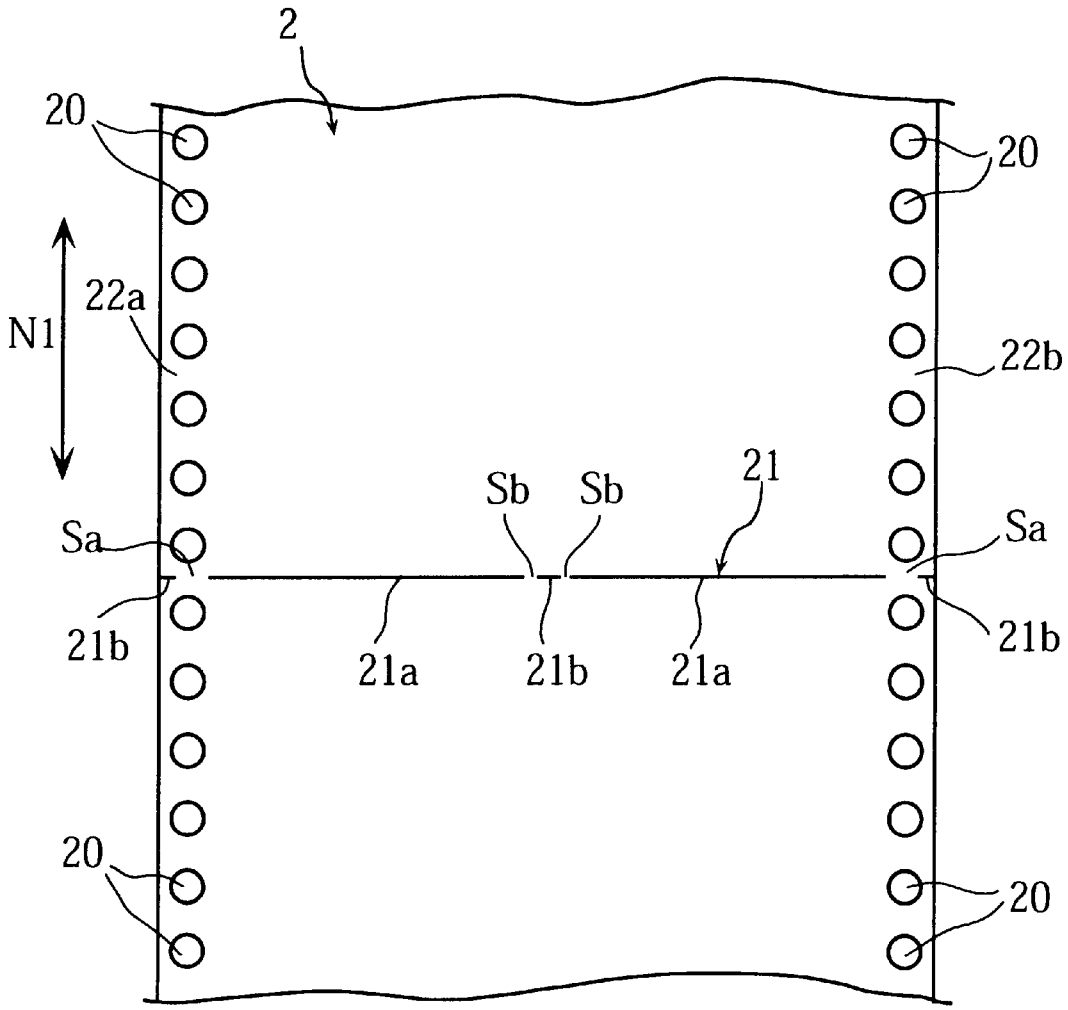
FIG. 2 is a front view showing a principal portion of an example of continuous paper.
Figure 3:
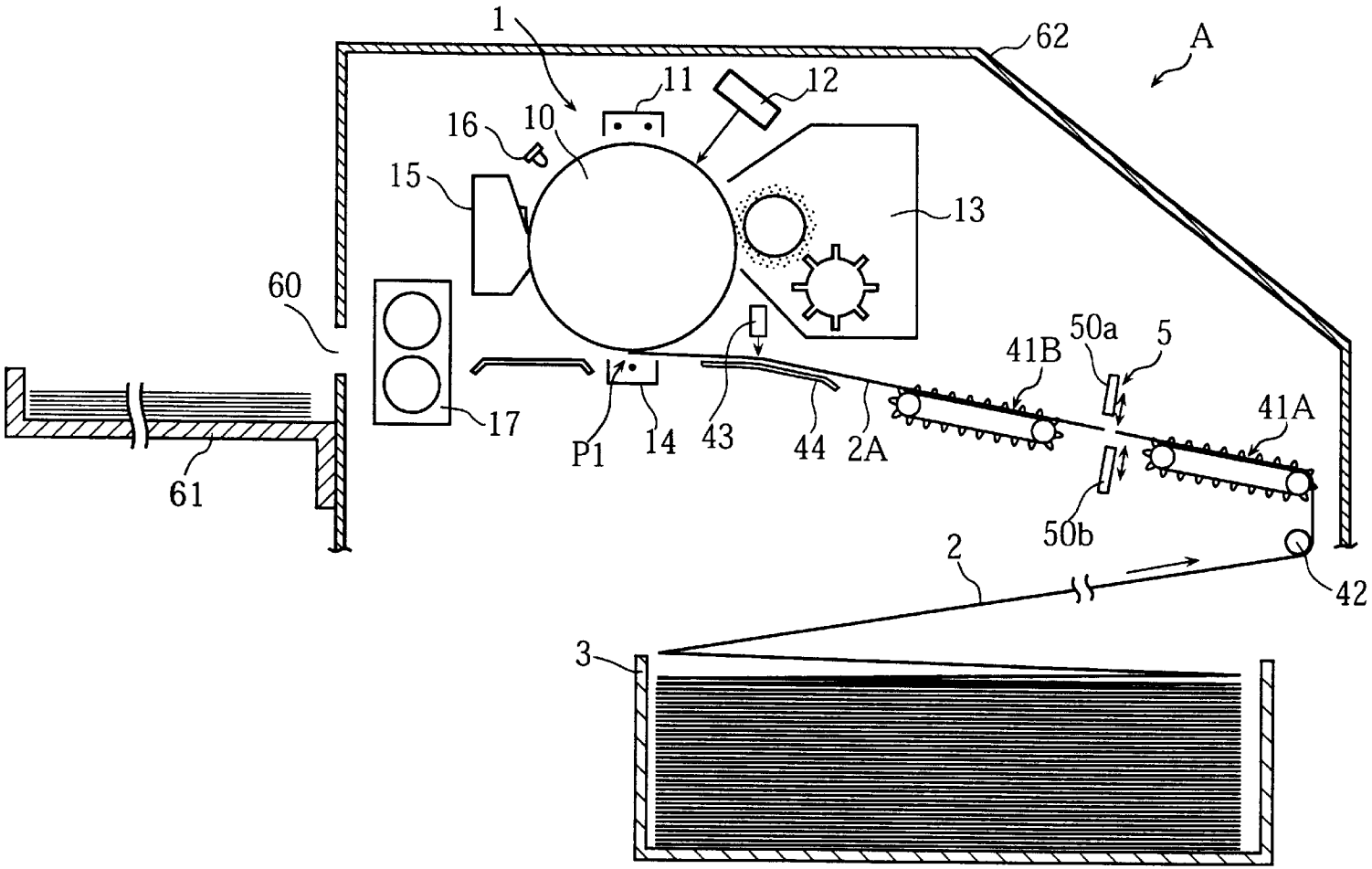
FIGS. 3 and 4 are schematic views illustrating how the printer of FIG. 1 operates.
Figure 4:
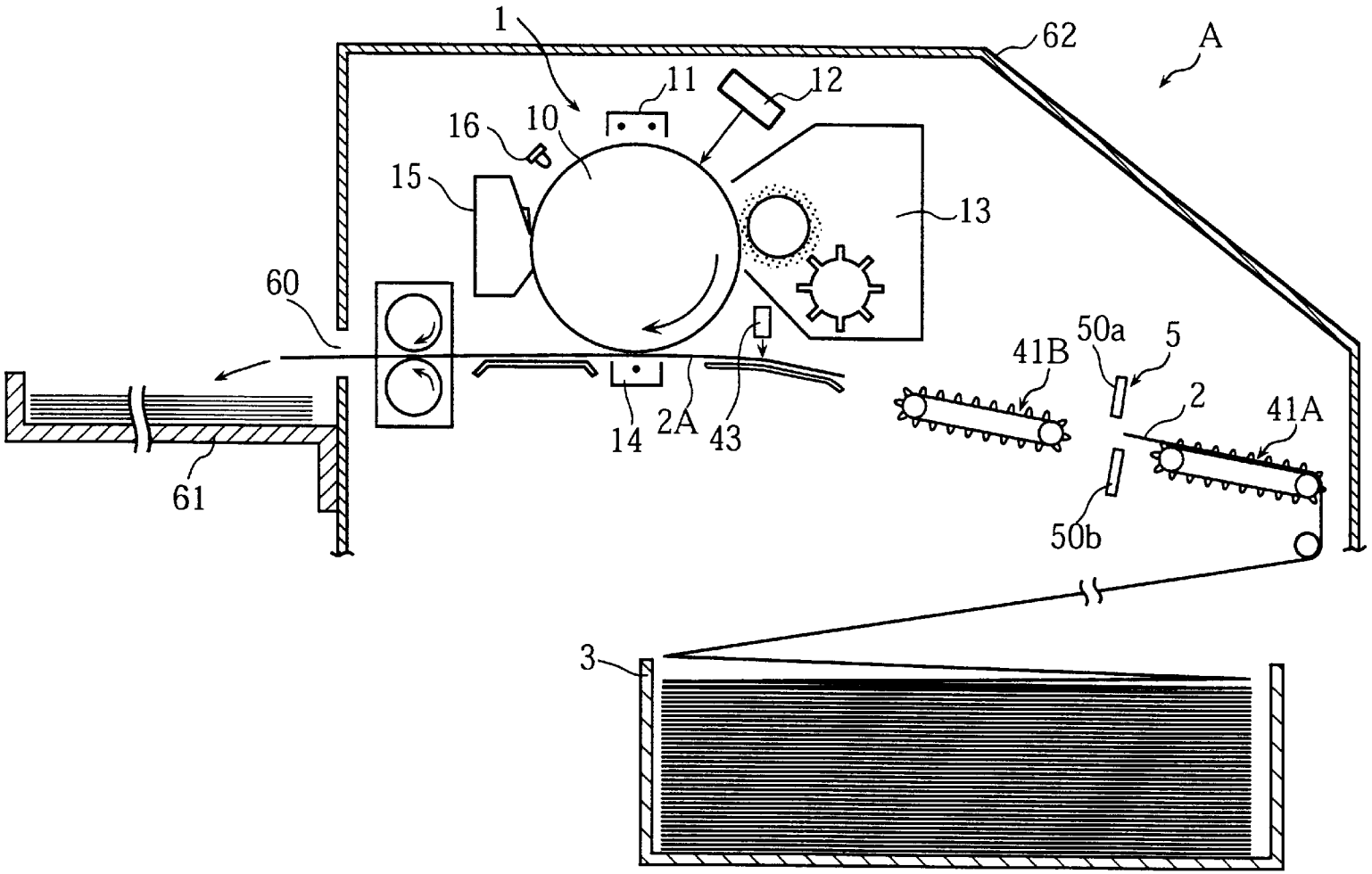

FIG. 1 is a schematic view showing an example of a printer according to a preferred embodiment of the present invention. FIG. 2 is a front view showing a principal portion of an example of continuous paper. FIGS. 3 and 4 are schematic views illustrating how the printer of FIG. 1 is operated.

For convenience of explanation, reference is first made to FIG. 2 which illustrates continuous paper 2 used for the printer of the preferred embodiment. As illustrated, the continuous paper 2 has an elongated configuration, extending in an N1-direction. The continuous paper 2 is formed with a plurality of feed holes 20 and a plurality of cut lines 21.

The feed holes 20 are divided into two rows, one of which extends along a longitudinal edge 22*a* of the continuous paper 2, while the other row extends along the opposite longitudinal edge 22*b*. In each row, the feed holes 20 are arranged at regular intervals.

The plurality of cut lines 21 are arranged at predetermined intervals as viewed longitudinally of the continuous paper 2. Each of the cut lines 21 includes two relatively long straight cuts 21*a* and a plurality of relatively short straight cuts 21*b*. Between the cuts 21*a* and 21*b* are provided connecting regions Sa or connecting regions Sb. The first connecting regions Sa are part of the longitudinal edges 22*a*, 22*b* of the continuous paper 2, whereas the second connecting regions Sb are part of the widthwise central portion of the continuous paper 2. The connecting regions Sa and Sb have small lengths (as viewed widthwise of the continuous paper 2). Thus, the sum of the lengths of the cuts 21*a*, 21*b* is nearly equal to the width of the continuous paper 2.

The continuous paper 2 shown in FIG. 2 is depicted as a plain sheet. However, the illustrated paper is merely an example and its arrangement may be modified. For instance, the continuous paper 2 may be provided with reference lines (such as rules), characters, figures or patterns, for example. Initially the continuous paper 2 is alternatively folded at the cut lines 21 and accommodated in the paper holder 3 (see FIG. 1).

As shown in FIG. 1, the printer A according to the present invention is provided with an image forming section 1 for producing images by an electrophotographic process (EP process), a feeding unit 4 for causing the continuous paper 2 to be transferred along a feeding path from the paper holder 3 to the image forming section 1, and a cutting unit 5 for cutting the continuous paper 2.

The image forming section 1 of the printer A is basically similar to that of a conventionally available printer arranged to print images by an EP process. Specifically, the image forming section 1 is provided with a rotatable photosensitive drum 10. Around the photosensitive drum 10 are a charge unit 11, a laser beam emitting unit 12 for optically writing images, a developing unit 13, a cleaner 15, and a static eliminating LED (light-emitting diode) 16.

The printer A also includes an image transfer unit 14 adjacent to the surface of the photosensitive drum 10, and a fixation unit 17 arranged downstream from the photosensitive drum 10. The fixation unit 17 is provided with a pair of heater rollers.

In the image forming section 1, a desired image (latent image) is electrostatically composed on the surface of the photosensitive drum 10, and this image is developed by toner supplied from the developing unit 13. Then, when a recording paper sheet is brought between the drum 10 and the image transfer unit 14, the toner-developed image is transferred from the drum 10 to the paper sheet.

The transferred image on the paper sheet is heated by the fixation unit 17 to be fixed to the sheet. Finally, the paper sheet is discharged from a discharge opening 60, and received by a stacker 61 arranged downstream from the fixation unit 17.

The feeding unit 4 includes first and second tractors 41A, 41B, for moving the continuous paper 2 toward the photosensitive drum 10 along the feeding path. The feeding unit 4 also includes a suitable number of guide rollers 42 (only one is shown in FIG. 1) and guide plates 44. These rollers 42 and plates 44 define the feeding path of the continuous paper 2.

Each of the first and the second tractors 41A, 41B is provided with a pair of endless belts 41*a* (only one is shown in FIG. 1) and a pair of rollers 41*b*, 41*c*. The endless belt 41*a* passes around the rollers 41*b*, 41*c*. Thus, when the rollers 41*b*, 41*c* are rotated, the endless belt 41*a* is moved accordingly for advancing the continuous paper 2 along the feeding path.

For achieving a proper paper feeding operation, the endless belt 41*a* is provided with a plurality of protrusions that are sequentially brought into engagement with the feed holes 20 of the continuous paper 2. In this manner, the continuous paper 2 is unfailingly advanced along the feeding path by the first and the second tractors 41A, 41B.

The cutting unit 5 is disposed between the first tractor 41A and the second tractor 41B for cutting the continuous paper 2. As shown in FIG. 1, the cutting unit 5 includes an upper plate 50*a* and a lower plate 50*b* which are vertically spaced from each other, with the feeding path extending therebetween.

In the illustrated embodiment, the upper and lower plates 50*a*, 50*b* are both movable toward and away from each other. (Alternatively, only one of them may be arranged to move.) The cutting edges of the respective plates 50*a*, 50*b* (i.e., the lower edge of the upper plate 50*a* and the upper edge of the lower plate 50*b*) are blunt. Nevertheless, as will be described later in detail, the two plates 50*a*, 50*b* can properly cut the continuous paper 2 at the respective cut lines 21. Preferably, the cutting edges of the respective plates 50*a*, 50*b* may be sharp so that the continuous paper 2 is properly cut even if the cut lines 21 are not provided.

As indicated by two-headed arrow N2 in FIG. 1, the position of the upper and lower plates 50*a*, 50*b* is adjustable to a limited extent along the feeding path. With such an arrangement, it is possible to vary the longitudinal length of a cut sheet to be separated from the continuous paper 2 by the cutting unit 5. The reciprocative range of the plates 50*a*, 50*b* is suitably limited for preventing the plates 50*a*, 50*b* from interfering with the first and second tractors 41A, 41B.

Still referring to FIG. 1, a sensor 43 is provided at a point adjacent to the feeding path and upstream from the photosensitive drum 10. The sensor 43 serves to detect, at a point P2, the passage of the leading portion of the continuous paper 2 fed by the feeding unit 4. Upon detection of the leading portion of the paper 2, the sensor 43 outputs corresponding detection signals.

Based on the detection signal from the sensor 43, the first and the second tractors 41A, 41B move the continuous paper 2 forward so that the leading portion of the paper 2 is brought to a point P1 on the surface of the photosensitive drum 10. (As illustrated in FIG. 1, the point P1 is in facing relation to the image transfer unit 14.)

When the leading portion of the paper 2 comes to the point P1, the cutting unit 5 is operated to cut the paper 2. The operation of the cutting unit 5 is controlled by non-illustrated controlling means incorporated in the printer A. Typically, the controlling means may be a microcomputer including a CPU, memories, and so forth, which are accommodated in a housing 62 of the printer A.

In the illustrated embodiment, use is made of the first and second tractors 41A, 41B for feeding the continuous paper 2. Since the endless belts 41*c* are provided with protrusions to be inserted into the feed holes 20 of the continuous paper 2, the two tractors 41A, 41B can properly advance the continuous paper 2 along the feeding path, whereby no slip and no positional deviation will occur between the continuous paper 2 and the tractors 41A, 41B.

From the above fact, it can be known that the displacement of the continuous paper 2 along the feeding path is in exact correspondence with the feeding motion of the endless belts 41*c*. Thus, the non-illustrated controlling means can determine, by monitoring the state of the tractors 41A and 41B in operation, what position the leading portion of the paper 2 is brought to at any given moment. Consequently, the controlling means can calculate when the leading portion of the continuous paper 2 arrives at the point P1 on the photosensitive drum 10.

In view of the above, it is possible to omit the sensor 43 provided for detecting the passage of the paper 2. If the sensor 43 may remain, it can be used for detecting positional deviation (not the passage) of the continuous paper 2 which may occur, for example, when the paper 2 is unduly torn.

When use is made of continuous paper formed with no feed holes, ordinary feed rollers (instead of the tractors 41A, 41B) may be used for feeding the continuous paper. Disadvantageously, the feed rollers may slip on the continuous paper, thereby failing to properly feed the continuous paper. This means that the non-illustrated controlling means may fail to calculate the correct position of the leading portion of the continuous paper only by monitoring the operational state of the feed rollers. In such an instance, the sensor 43 for detecting the passage of the continuous paper may be of great help.

The operation and advantages of the printer A will now be described below.

First, referring to FIG. 1, the first and the second tractors 41A, 41B are actuated for feeding the continuous paper 2 from the paper holder 3 to the photosensitive drum 10. This feeding operation with the continuous paper 2 is performed properly, as previously described, since the protrusions of the endless belts 41*a* of the first and the second tractors 41A, 41B are sequentially brought into engagement with the feed holes 20 formed in the continuous paper 2. Thus, the continuous paper 2 is caused to move an exact distance corresponding to the rotational movement of the rollers 41*b*, 41*c* of the tractors 41A, 41B.

Referring to FIG. 2, the left-hand longitudinal edge 22*a* is not completely separated by the cut line 21. More specifically, the left-hand short cut 21*b* and the left-hand long cut 21*a* of the cut line 21 are spaced from each other by a small distance, thereby providing a connecting region Sa. Similarly, the right-hand longitudinal edge 22*b* contains another connecting region Sa. Because of these connecting regions Sa, the continuous paper 2 is provided with an appropriate strength to withstand the tension exerted on the paper 2 during the transferring operation. Thus, the driving force generated by the first and second tractors 41A, 41B is properly transmitted to the continuous paper 2 without causing the continuous paper 2 to be torn prematurely at the cut lines 21. This advantage is enhanced by the generally central connecting regions Sb provided between the relatively long cuts 21*a* and the relatively short cut 21*b*.

When the leading portion of the continuous paper 2 arrives at the predetermined point P1 on the photosensitive drum 10, the cutting unit 5 is actuated to cut the continuous paper 2. To this end, the cutting unit 5 is disposed at a suitable position along the feeding path, so that the two plates 50*a*, 50*b* can come into contact with the cut line 21 of the paper 2 when the leading portion of the paper 2 reaches the point P1. With such an arrangement, the continuous paper 2 is properly cut at the cut line 21 by the cutting unit 5.

In this connection, it should be appreciated that the cut line 21 includes the relatively long cuts 21*a* extending widthwise of the continuous paper 2. With such an arrangement, the continuous paper 2 pulled along the feeding path with a suitable tension can readily be cut at the cut line 21 when the plates 50*a*, 50*b* only slightly engage with the continuous paper 2. This means that the cutting force needed for cutting the continuous paper 2 is rendered advantageously small. Thus, the continuous paper 2 is prevented from being unduly pulled backward (i.e., upstream of the feeding path) when the plates 50*a*, 50*b* are brought into contact with the paper 2 for cutting the paper.

By preventing the backward deviation of the continuous paper 2 in the above manner, the leading portion of the resulting cut sheet 2A can substantially remain at the point P1 of the photosensitive drum 10. For enabling more reliable prevention of the positional deviation of the cut sheet 2A from the point P1, use may be made of pinch rollers (not shown) to press the cut sheet 2A therebetween. Such pinch rollers may be arranged at suitable locations upstream from the photosensitive drum 10.

While the cutting operation is being performed, the continuous paper 2 may be halted for a while. Alternatively, the paper 2 may continue to be advanced along the feeding path during the cutting operation.

Some of the technically significant features of the above embodiment in terms of accurate image transfer may be as follows. Firstly, the leading portion of the cut sheet 2A is initially held in contact with the photosensitive drum 10. (In other words, the cut sheet 2A does not need to be additionally moved along the feeding path for coming into engagement with the photosensitive drum 10 after the cut sheet 2A is obtained from the continuous paper 2.) Secondly, the positioning of the leading portion of the cut sheet 2A relative to the photosensitive drum 10 is performed accurately during the feeding process of the continuous paper 2. Thirdly, the leading portion of the cut sheet 2A can electrostatically cling to the surface of the photosensitive drum 10 which is electrostatically charged.

Because of the above features, the toner image produced on the photosensitive drum 10 is transferred onto the predetermined region in the cut sheet 2A with excellent positional accuracy. Thus, the resulting image printed on the cut sheet 2A will appear without positional deviation. when no printing operation is to be performed immediately after the above-stated printing operation ("first printing operation" below) with respect to the cut sheet 2A, the first tractor 41A may be turned off after the cut sheet 2A is separated from the continuous paper 2. In this case, the continuous paper 2 does not extend beyond the cutting unit 5, as shown in FIG. 4.

Alternatively, the first and the second tractors 41A, 41B may be actuated for a while after the cut sheet 2A is separated from the continuous paper 2. In this case, the leading portion of the continuous paper 2 may be brought to a point located upstream from, but close to, the photosensitive drum 10. When the leading portion of the paper 2 reaches the particular point, the first and the second tractors 41A, 41B are turned off.

When another printing operation is to be performed successively after the first printing operation, the continuous paper 2 may continue to be moved toward the photosensitive drum 2 even after the cut sheet 2A is separated from the continuous paper 2. Thus, while the first printing operation is being performed with the cut sheet 2A, the continuous paper 2 may still be advancing along the feeding path. Then, in a certain period of time, another cut sheet is separated from the continuous paper 2, and a desired image is to be printed on this cut sheet.

In place of the continuous paper 2 used in the illustrated embodiment, use may be made of another type of continuous paper which may also be provided with suitable cut lines. The intervals at which the cut lines of the new continuous paper are arranged may be different from those of the continuous paper 2. In such an instance, when the leading portion of the new continuous paper is brought to the point P1 on the photosensitive drum 10, the cut line of the new continuous paper may be located at a position different from where the cut line 21 of the above-described continuous paper 2 was located.

In this connection, it should be appreciated that the cutting unit 5 is adjustable in position along the feeding path, as indicated by the arrow N2 in FIG. 1. Thus, even when the cut line is positionally shifted to a certain extent along the feeding path, the cutting unit 5 can properly cut the new continuous paper at the cut line. In this manner, the illustrated printer A of the present invention can deal with various types of continuous paper having cut lines arranged at various intervals.

In the preferred embodiment described above, the continuous paper 2 is cut into a separate sheet when the leading portion of the paper 2 comes into contact with the surface of the photosensitive drum 10. The present invention, however, is not limited to this embodiment. For instance, the continuous paper 2 may be cut after the leading portion of the paper 2 has reached the drum 10 and is further advanced to a certain extent. In this connection, more detailed description will be given below with reference to FIG. 1.

FIG. 1 illustrates an instance where the cutting unit 5 is set at a position corresponding to the intervals at which the cut lines 21 (FIG. 2) of the paper 2 are arranged. It is now supposed that in place of the continuous paper 2 ("first continuous paper" below), use is made of a different type of continuous paper ("second continuous paper" below) whose cut lines are arranged at certain intervals. Here, the distance between adjacent cut lines of the second continuous paper is greater than that of the first continuous paper. It is also supposed that the cutting unit 5 is not to be moved from the initial position along the feeding path.

In the above instance, when the leading portion of the second continuous paper arrives at the point P1 on the photosensitive drum 10, a relevant cut line is yet located upstream from the paired plates 50*a*, 50*b* of the cutting unit 5. Thus, in order to properly cut the second continuous paper, it is necessary to further advance the paper along the feeding path until the relevant cut line comes between the upper and the lower plates 50*a*, 50*b* of the cutting unit 5. When the cut line is brought to this particular point, the cutting unit 5 is operated to cut the second continuous paper. At this stage, the image-printing with respect to the leading portion of the second continuous paper may already be started.

In the manner described above, there is no need to adjust the position of the cutting unit 5 whenever one continuous paper is to be replaced with another continuous paper.

For cutting the continuous paper, it is possible to use various kinds of cutting tools. For instance, a pair of blades with sharp cutting edges may preferably be used in some applications. In other applications, a circular rotary cutter which is movable across (widthwise of) the continuous paper may be useful.

Figure 5A:
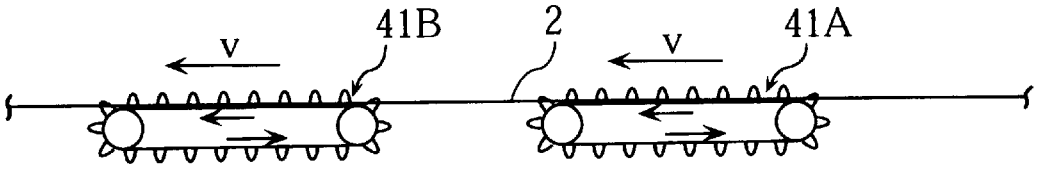
FIGS. 5A and 5B are schematic views illustrating how a cutting mechanism works.
Figure 5B:
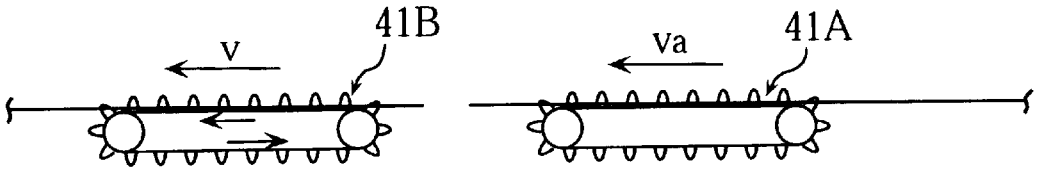

Still further, it is possible to cut the continuous paper without using any one of the cutting units described above. To this end, use may be made of the first and the second tractors 41A, 41B, as shown in FIGS. 5A–5B. Specifically, it is supposed that the first and the second tractors 41A, 41B are initially operated to feed the continuous paper 2 at a constant speed of V (see FIG. 5A). Then, as shown in FIG. 5B, the speed of the first tractor 41A (which is located upstream from the second tractor 41B) is reduced to a lower speed Va (which may include zero). In this manner, a tension is exerted on the continuous paper 2 to pull the paper longitudinally thereof, so that the continuous paper 2 will be separated at the cut line 21 (see FIG. 2) located between the two tractors 41A, 41B.

According to the present invention, as stated above, it is not always necessary to provide a cutting device which is exclusively used for cutting the continuous paper. Without such a device, other components of the printer may be used both for cutting the continuous paper and for performing another function.

Figure 6A:
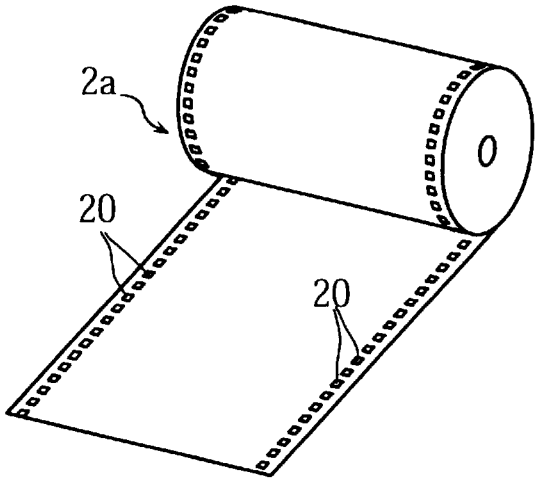
FIGS. 6A–6C are schematic views showing various types of continuous paper.
Figure 6B:
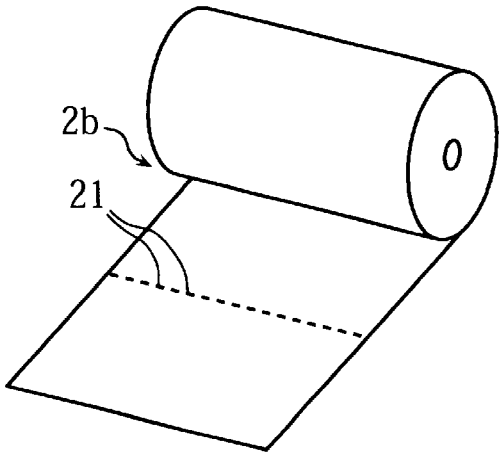
Figure 6C:
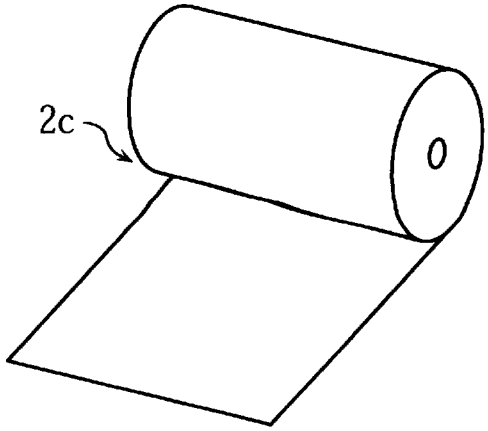

Reference is now made to FIGS. 6A–6C illustrating various types of continuous paper (roll-type continuous paper) which are usable for the printer of the present invention. These continuous papers are different from the continuous paper 2 shown FIG. 2.

Specifically, the continuous paper 2*a* shown in FIG. 6A is formed with feed holes 20 (each of which has a rectangular configuration) but not with cut lines. The continuous paper 2*b* shown in FIG. 6B has no feed holes but is formed with cut lines (perforations) 21. The continuous paper 2*c* shown in FIG. 6C is not formed with feed holes nor cut lines. Instead of the continuous papers 2*a*–2*c* described above, a non-roll type of continuous paper may be used for a printer of the present invention.

Each component or element of the printer (particularly, the cutting unit and the feeding unit) may suitably be arranged so that the printer can deal with various kinds of continuous paper. For instance, when use is made of continuous paper formed with no feed holes, the printer may incorporate rotatable rollers (instead of tractors as shown in FIG. 1) for feeding the continuous paper.

In the illustrated embodiment, the endless belts 41*a* provided with protrusions are used for the first and the second tractors 41A, 41B. In place of these endless belts, the tractors 41A, 41B may be provided with rotatable rollers provided with protrusions for engaging with the continuous paper.

Figure 7:
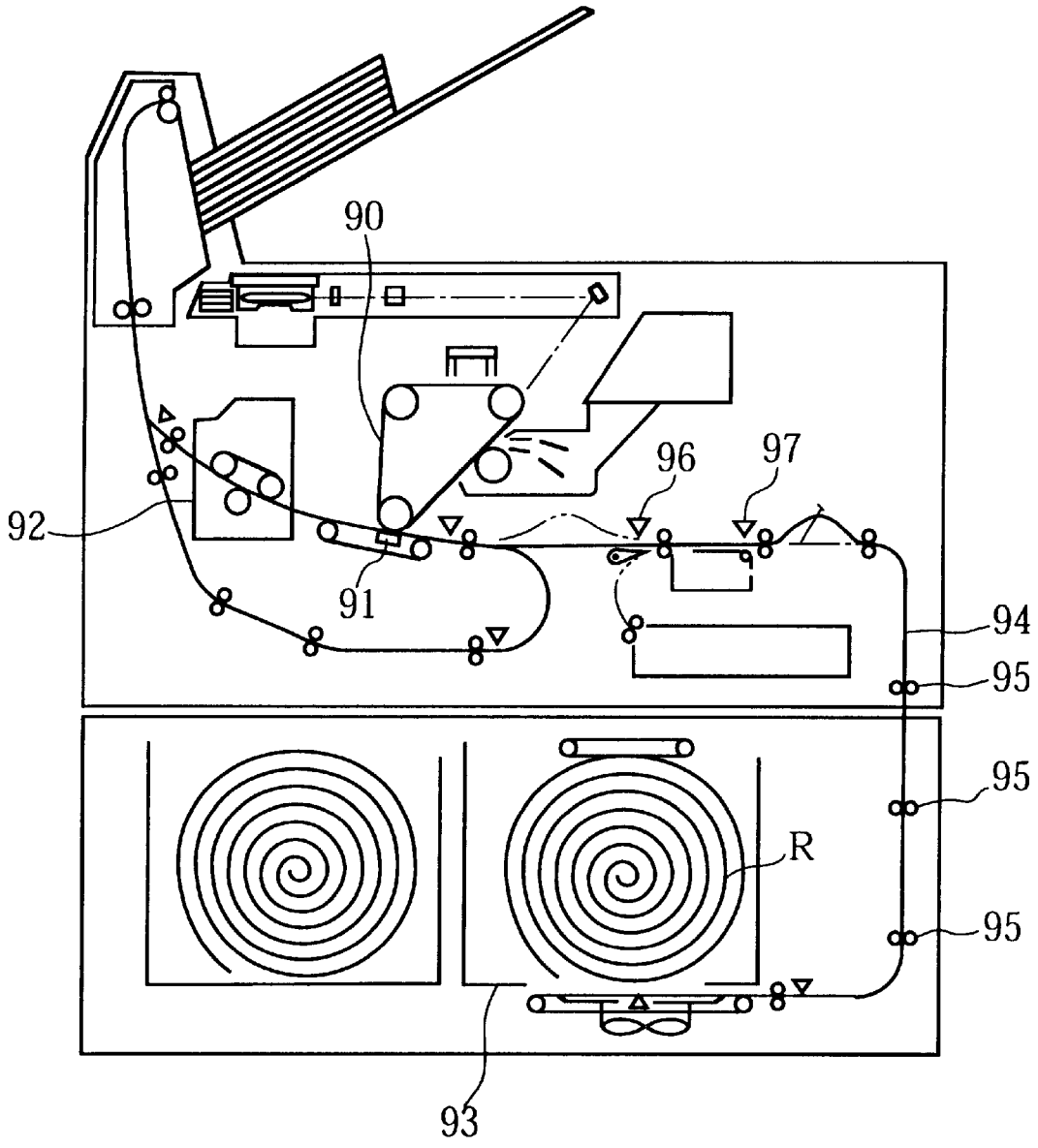
FIG.7 PRIOR ART
FIG. 7 is a schematic view showing an example of conventional printer.

Further, in the illustrated embodiment, the photosensitive drum 10 is used a photosensitive unit. Alternatively, use may be made of a photosensitive belt as shown in FIG. 7 (prior art). The specific design of the image forming section including such a photosensitive unit is not limited to the illustrated example but may be varied in many ways.

According to the present invention, the continuous paper is cut into a separate cut sheet after the leading portion of the continuous paper comes into contact with the surface of the photosensitive drum. In this manner, since the cut sheet does not need to be additionally advanced to engage with the photosensitive drum, the leading portion of the cut sheet is accurately positioned relative to the photosensitive drum. Thus, as compared with the conventional printer (in which the continuous paper is cut into a separate cut sheet before the leading portion of the paper reaches the photosensitive belt), the desired image is properly printed on the cut sheet without positional deviation.

The present invention being thus described, it is obvious that the same may be varied in many other ways. Such variations are not to be regarded as a departure from the spirit and scope of the present invention, and all such modifications as would be obvious to those skilled in the art are intended to be included within the scope of the following claims.

What is claimed is:

1. A printer with a photosensitive member comprising:

an image forming section for forming an toner image on a surface of the photosensitive member;

continuous paper to which the toner image is transferred from the photosensitive member;

a paper feeding unit for feeding the continuous paper along a feeding path to the surface of the photosensitive member; and a cutting unit for cutting the continuous paper to provide a cut sheet, the cutting unit being arranged upstream from the photosensitive member;

wherein the paper feeding unit includes a first tractor arranged upstream from the photosensitive member, and a second tractor arranged upstream from the photosensitive member but downstream from the first tractor, each of the first and second tractors including a rotating member provided with a plurality of protrusions which are inserted into feed holes formed in the continuous paper; and wherein the cutting unit is arranged to cut the continuous paper between the first tractor and the second tractor after a leading portion of the continuous paper reaches the surface of the photosensitive member.

2. The printer according to claim 1, further comprising a detector for detecting the leading portion of the continuous paper, the detector being arranged upstream from the photosensitive member.

3. The printer according to claim 2, wherein the paper feeding unit is arranged to advance the continuous paper by a predetermined amount after the leading portion of the continuous paper is detected by the detector.

4. The printer according to claim 3, wherein the cutting unit is arranged to cut the continuous paper after the continuous paper is advanced by said predetermined amount.

5. The printer according to claim 1, wherein the feed holes are disposed along a longitudinal edge of the continuous paper, the feed holes being arranged at regular intervals.

6. The printer according to claim 1, wherein the rotating member is an endless belt.

7. The printer according to claim 1, wherein the rotating member is a roller.

8. The printer according to claim 1, wherein the continuous paper is provided with cut lines arranged at regular intervals longitudinally of the continuous paper, each of the cut lines including at least one cut.

9. The printer according to claim 8, wherein the cutting unit is arranged to cut the continuous paper at the cut lines.

10. The printer according to claim 8, wherein the cutting unit is movable along the feeding path of the continuous paper.

11. The printer according to claim 1, wherein the first tractor is arranged to exert a resisting force on the continuous paper advancing along the feeding path, so that the continuous paper is cut at a cut line.

12. The printer according to claim 11, wherein the second tractor is driven at a higher rate than the first tractor for cutting the continuous paper.

13. The printer according to claim 8, wherein the cut is arranged to avoid a portion of a longitudinal edge of the continuous paper.

14. The printer according to claim 8, wherein each of the cut lines includes a relatively long cut and a relatively short cut which are arranged to avoid a portion of a longitudinal edge of the continuous paper.

15. A printer with a photosensitive member comprising:

an image forming section for forming a toner image on a surface of the photosensitive member;

continuous paper to which the toner image is transferred from the photosensitive member; and a paper feeding unit for feeding the continuous paper along a feeding path to the surface of the photosensitive member;

wherein the continuous paper is provided with cut lines arranged at regular intervals longitudinally of the continuous paper, each of the cut lines including at least one cut;

wherein the paper feeding unit includes a first tractor arranged upstream from the photosensitive member, and a second tractor arranged upstream from the photosensitive member but downstream from the first tractor, each of the first and the second tractors including a rotating member provided with a plurality of protrusions which are inserted into feed holes formed in the continuous paper; and wherein the second tractor is driven at a higher rate than the first tractor for cutting the continuous paper at each cut line between the first tractor and the second tractor after a leading portion of the continuous paper reaches the surface of the photosensitive member.

16. A printer with a photosensitive member comprising:

an image forming section for forming a toner image on a surface of the photosensitive member;

continuous paper to which the toner image is transferred from the photosensitive member;

a paper feeding unit for feeding the continuous paper along a feeding path to the surface of the photosensitive member; and a cutting unit for cutting the continuous paper to provide a cut sheet, the cutting unit being arranged upstream from the photosensitive member;

wherein the continuous paper is provided with cut lines arranged at regular intervals longitudinally of the continuous paper, each of the cut lines including at least one cut;

wherein the cutting unit is arranged to cut the continuous paper after a leading portion of the continuous paper reaches the surface of the photosensitive member; and wherein the cutting unit is movable along the feeding path of the continuous paper.

17. A printer with a photosensitive member comprising:

an image forming section for forming a toner image on a surface of the photosensitive member;

continuous paper to which the toner image is transferred from the photosensitive member;

a paper feeding unit for feeding the continuous paper along a feeding path to the surface of the photosensitive member; and a cutting unit for cutting the continuous paper to provide a cut sheet, the cutting unit being arranged upstream from the photosensitive member;

wherein the cutting unit is arranged to cut the continuous paper after a leading portion of the continuous paper reaches the surface of the photosensitive member;

wherein the continuous paper is provided with cut lines arranged at regular intervals longitudinally of the continuous paper, each of the cut lines including at least one cut;

wherein the paper feeding unit includes a first tractor arranged upstream from the photosensitive member, and a second tractor arranged downstream from the first tractor, each of the first and the second tractors including a rotating member provided with a plurality of protrusions which are inserted into feed holes formed in the continuous paper; and wherein the first tractor is arranged to exert a resisting force on the continuous paper advancing along the feeding path, so that the continuous paper is cut at each cut line.

* * * * *